US011286137B2

(12) United States Patent
Eiwan

(10) Patent No.: US 11,286,137 B2
(45) Date of Patent: Mar. 29, 2022

(54) CRANE WITH ANTI-COLLISION DEVICE AND METHOD FOR OPERATING MULTIPLE SUCH CRANES

(71) Applicant: Liebherr-Werk Biberach GmbH, Biberach an der Riss (DE)

(72) Inventor: Christoph Eiwan, Ummendorf (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 0 days.

(21) Appl. No.: 16/919,742

(22) Filed: Jul. 2, 2020

(65) Prior Publication Data

US 2020/0399098 A1 Dec. 24, 2020

Related U.S. Application Data

(63) Continuation of application No. PCT/EP2019/050155, filed on Jan. 4, 2019.

(30) Foreign Application Priority Data

Jan. 4, 2018 (DE) ..... 10 2018 100 133.9

(51) Int. Cl.
*B66C 15/00* (2006.01)
*B66C 15/04* (2006.01)
(Continued)

(52) U.S. Cl.
CPC ..... *B66C 15/045* (2013.01); *B66C 13/40* (2013.01); *B66C 23/88* (2013.01)

(58) Field of Classification Search
CPC ..... B66C 15/045; B66C 15/065; B66C 13/40; B66C 13/46; B66C 23/16
See application file for complete search history.

(56) References Cited

U.S. PATENT DOCUMENTS 5,634,565 A * 6/1997 Lesage ..... G01S 17/931 212/276
2005/0256608 A1* 11/2005 King ..... B66C 19/002 700/213
(Continued)

FOREIGN PATENT DOCUMENTS

DE 102006040782 3/2008
DE 102015010726 2/2017
(Continued)

*Primary Examiner* — Emmanuel M Marcelo
(74) *Attorney, Agent, or Firm* — Levine Bagade Han LLP

(57) ABSTRACT

The invention relates to a method for operating multiple cranes (1, 2), the movements of which are monitored for imminent collisions by anti-collision devices of the cranes, and to cranes comprising at least one movement device for moving a crane element, a control unit (13) for actuating the movement device, and an anti-collision device (17, 18) for monitoring the crane movements of the crane element for possible collisions with another crane. According to the invention, in the event of an imminent collision between a first crane (1) being operated and a second crane (2) which is not being operated, the first crane is stopped; a remote control connection (21) is established from the first crane to the second crane; the second crane is moved out of the collision region (130), which is interfering with an intended movement of the first crane, by means of control commands, which are provided at the first stopped crane and transmitted to the second crane by the remote control connection; the second crane is stopped after being moved out of the collision region by remote control; and the first crane is started up again so that the first crane can carry out its task.

19 Claims, 2 Drawing Sheets

(51) Int. Cl.
*B66C 13/40* (2006.01)
*B66C 23/88* (2006.01)

(56) References Cited

U.S. PATENT DOCUMENTS

| | | | | |
|---|---|---|---|---|
| 2013/0299440 | A1 | 11/2013 | Hermann et al. | |
| 2017/0031339 | A1* | 2/2017 | Corbeil | G06Q 50/08 |
| 2019/0073736 | A1* | 3/2019 | Duca | G06Q 10/0631 |
| 2019/0102712 | A1* | 4/2019 | Duca | B65G 1/0421 |
| 2021/0072727 | A1* | 3/2021 | Stanger | E02F 9/262 |
| 2021/0215139 | A1* | 7/2021 | Roodenburg | E02B 17/021 |

FOREIGN PATENT DOCUMENTS

| | | |
|---|---|---|
| FR | 2876992 | 4/2006 |
| FR | 3030469 | 6/2016 |
| KR | 10 20140132602 | 11/2014 |
| WO | WO 2019/134966 | 7/2019 |

* cited by examiner

CRANE WITH ANTI-COLLISION DEVICE AND METHOD FOR OPERATING MULTIPLE SUCH CRANES

CROSS-REFERENCE TO RELATED APPLICATIONS

This application is a continuation of International Patent Application Number PCT/EP2019/050155 filed Jan. 4, 2019, which claims priority to German Patent Application Number 10 2018 100 133.9 filed Jan. 4, 2018, the contents of which are incorporated herein by reference in their entireties.

BACKGROUND

The present invention relates to a method of operating a plurality of cranes whose movements are monitored for imminent collisions by anti-collision devices of the cranes and to cranes having at least one movement device for moving a crane element, having a control unit for controlling the movement device, and having an anti-collision device for monitoring the crane movements of the crane element for possible collisions with another crane.

As a rule a plurality of cranes whose typically circular working zones partially overlap are deployed simultaneously on construction sites, which can be due to the spatial circumstances of the construction site, on the one hand, but is also necessary, on the other hand, to achieve a coverage of the construction site area that is as complete as necessary. To prevent collisions between the cranes, in particular their booms, in the region of the partial overlap of the cranes, the cranes are typically equipped with anti-collision devices that monitor crane movements and intervene in the crane control to slow or stop movements when a collision is imminent in the working zone at risk of collisions, that is in the aforesaid overlap zone.

Said anti-collision devices can here determine the location or the position and movement of their own crane via a suitable sensor system, for example the alignment of the boom about the rotary axis of rotation by a rotary encoder at the slewing gear, the luffing position of the boom by a luffing sensor, or the location of the trolley at the boom, and thus the outreach of the hoist rope, by a trolley sensor. The anti-collision device knows when the crane moves in the previously named overlap zone that harbors the risk of a collision with another crane by reference to collision zones that can be fixed and using the crane position detected by sensors. On the other hand, the anti-collision devices of the cranes can communicate with one another so that a respective anti-collision device knows whether the other crane is likewise moving in the overlap zone or is heading toward it. The anti-collision devices for this purpose transmit the position data and/or state data of "their" crane to the anti-collision devices of the other cranes by sensors or in a different manner so that the anti-collision devices of a respective crane can take account of the position data and/or state data of the other cranes when it is a question of deciding whether an intervention into the crane control should take place and a respective crane movement should be influenced, in particular stopped.

Such an anti-collision system that comprises the anti-collision devices of the individual cranes connected over a network can, however, bring along restrictions in specific situations that impede the construction site operation in an unwanted manner. In particular when a crane is taken out of operation, for example is in the weathervane position, it is to date not normally possible to travel this unoccupied crane out of the collision zone so that another crane whose working zone overlaps the unoccupied crane is correspondingly obstructed in its work radius. Since the anti-collision device may only influence the movements of its own crane in dependence on the position information and/or status information of the other crane, the unoccupied crane cannot be actuated and moved away. A crane operator usually has to come to activate the unoccupied crane and to drive it out of the collision zone or the job assignment of the impeded crane has to be postponed until the unoccupied crane is also occupied again.

To avoid or reduce the impeding of the working zone of a crane by other cranes that are unoccupied or have been taken out of operation, it is proposed in document FR 30 30 469 A1 not to take an unoccupied crane in the weathervane position completely out of operation, but rather to switch it into an autopilot mode in which the crane can admittedly freely align itself with the wind as long as no other crane wants to travel into the collision zone. If, however, an adjacent crane wants to travel into the collision zone, the autopilot function independently steers the unoccupied crane out of the overlap zone. In said autopilot made, the anti-collision device of the unoccupied crane continues to receive the position data and movement data of the adjacent crane in order to drive the unoccupied crane independently out of the overlap zone if necessary if the adjacent crane approaches the overlap zone, with the crane only be rotated so much that its boom extends approximately tangentially to the circular working zone of the adjacent crane to keep the imminent additional wind resistance as small as possible.

Such an autopilot function, however, requires a complex structure of the crane control and also of the crane sensor system to be able to perform automated crane movements without a control by a crane operator with sufficient safety. Conventional cranes are often not able to do this or have to be retrofitted in a complex and/or expensive manner to enable such automated crane movements out of the collision zone or to be able to perform them with sufficient safety.

It is therefore the underlying object of the present invention to provide an improved method and an improved crane of the initially named kind which avoid disadvantages of the prior art and further develops the latter in an advantageous manner. An improved use and design of the anti-collision device should in particular be provided that reliably prevents crane collisions, but at the same time avoids unwanted impediments to work assignments without requiring complex crane control retrofitting for this purpose.

SUMMARY

It is therefore proposed to travel a disruptive, unoccupied crane out of the collision zone in an operated-supported manner and thus under the control of a crane operator to enable a work assignment of an adjacent crane that could otherwise not travel into the overlap zone having the unoccupied crane under the monitoring of its anti-collision device. It is proposed in accordance with the invention that on an imminent collision between a first crane in operation and a second crane out of operation, the first crane is stopped, a remote control connection from the first crane to the second crane is set up, the second crane is moved out of the collision zone by control commands that are provided at the first, stopped crane provides and are communicated to the second crane by the remote control connection, and the second crane is stopped after the remote controlled moving out of the collision zone and the first crane is put into motion again so that the first crane can perform its work. A crane that is unoccupied and out of operation per se can hereby be safely traveled out of the collision zone under the control of the crane operator if it is disrupting the work assignment of an adjacent crane without the crane requiring a complex fully automatic crane control for this purpose that enables automated crane movements.

In a further development of the invention, the control commands are transmitted via the network of the anti-collision devices over which otherwise the position data and/or state date of the cranes are transmitted between the anti-collision devices. It would generally also be possible to provide a separate communication channel for the transmission of the control commands from the provisionally stopped crane to the crane that is to be remote controlled, over which channel only the control commands are transmitted. The use of the communication network between the anti-collision devices is, however, particularly advantageous since the already present infrastructure is used and the anti-collision devices can monitor the movements to be expected directly with reference to the control commands.

Said control commands for the remote control of the crane to be moved away can be generated in different manners per se at the aforesaid first crane. The control unit, present per se to control the first crane, and its input means can advantageously be used for this. The control commands for the remote control of the second crane can in particular be generated by actuating the input means of the control unit of the first crane and can then be transmitted to the second crane by said remote control communication connection. Said input means can here be configured as manually actuable, but can also comprise other input means that can, for example, be actuated acoustically or by gesture control or in a different manner. Such input means can, for example, comprise a joystick, actuation switches and/or actuation sliders, a rotary knob, or a touchscreen. Said input means can in particular be provided in the crane operator's cab of the respective crane. The input means of a portable actuation unit and/control unit can, however, optionally also be used by means of which said first crane can be actuated by a crane operator located on the ground. Since the "particular" first crane the control unit together with the input means belongs to per se is stopped, the control commands generated by it are not performed by the first crane itself, but can rather be transferred to the second crane over the remote control connection. The control unit of the first crane and/or its anti-collision device works/work here in a remote control mode in which the control commands generated at the input means are not used to control the drives of its own crane, bur are rather sent to the second crane over the remote control connection.

Alternatively or additionally, the control commands for the remote control of the second crane can, however, also be generated automatically or semiautomatically by a movement control module of the anti-collision device of the first crane when the first crane has been stopped in the named manner and the remote control connection to the second crane has been established. Such a movement control module can, for example, be configured in the form of a software module in the electronically configured anti-collision device and can there be stored in a memory and worked through by a microprocessor of the anti-collision device. Said movement control module can here generate the control commands for the remote control of the second crane and for moving the second crane out of the collision zone using the position data and/or status data that the second crane transmits to the first crane and/or with reference to the position data and/or status data that the anti-collision device of the first crane has determined with respect to the first crane.

A semiautomatic generation of the control commands for the remote control of the crane to be moved away by said movement control module can take place in this process, for example, such that a proposal for a corresponding control command is made to the crane operator, for example on a display or another presentation apparatus, optionally in combination with a confirmation prompt so that the crane operator can confirm the proposed control command if he considers it sensible. In a further embodiment, the generation of the control commands for the remote control of the second crane can, however, also take place fully automatically at the first crane.

The second crane can nevertheless, however, also be fully manually remote controlled, which can optionally also include acoustic, technical gesture, or other control inputs. For this purpose, the crane operator of the first crane can confirm its crane control and the associated input means in a customary manner per se to remote control the second crane and to move it out of the collision zone. This enables a particularly simple configuration of the crane control units that can remain conventionally configured and can only be provided with an interface for receiving and/or outputting remote control commands.

The remote control commands received at the control unit of the second crane are worked through by the control unit of the second crane in a customary manner per se, are in particular treated as control signals that would have been input at the input means of the control unit of the second crane itself. The control unit of the second crane can convert the received remote control signals into corresponding control signals to the at least one movement device of the second crane to set its drives into motion or to accelerate or stop them.

Depending on the configuration and arrangement of the cranes and on their respective positions, different movements can be remote controlled by the remote control device of the anti-collision devices. The slewing gear of the second crane can in particular be actuated in said manner to rotate its boom about an upright axis and hereby to move it out of the collision zone. If the cranes, in particular their booms, are arranged at different heights, it may optionally also be sufficient to travel the trolley of the higher crane further inwardly to move the hoist rope running down from the trolley out of the collision zone with the first crane. In this case, said remote control device can initiate a movement of the trolley of the second crane. If the cranes have luffable booms, the remote control device can also resolve a collision in that the boom of the second crane is luffed up and its radius is thereby reduced, which can take place, for example, in combination with a rotation of the boom about its upright axis.

It can be favorable from the point of view of the time sequence if the aforesaid steps of stopping the first crane and establishing the remote control connection take place after one another in an orderly fashion. The first crane can in particular first be stopped before the remote control connection is then established between the first crane and the second crane. Conversely, after the remote controlled movement of the second crane out of the collision zone, the remote control connection can first again be interrupted before the first crane is set into motion again.

Said stopping of the first crane can include all the drive devices being taken out of operation or stopped or deactivated and the associated movement devices being decelerated. The slewing gear for the rotation of the boom about an upright axis and/or the hoisting gear for raising and lowering a hoist rope and the lifting hook fastened thereto and/or a trolley drive for traveling a trolley can in particular be stopped and braked.

To ensure that on the actuation of the input means of the control unit of the first crane, the control commands hereby generated are only used to remote control the second crane and do not effect any control or movements of the drives of the first crane itself, said stopping of the first crane can further include the control command connections between the control unit of the first crane and its movement devices being deactivated and/or the drive devices being decoupled from the control unit in a technical control manner and/or the generated control commands so-to-say being diverted to the remote control device. In the remote control mode, for example, the signal outputs of the input means can be switched to the remote control module and can be cut off from the customary control signal connections to the drive devices of the first crane. This can take place in a technical hardware manner by corresponding signal splitters, but also in a technical software manner, for example by a corresponding databus control.

In accordance with a further aspect of the present invention, the described remote control module cannot only be used to move an unoccupied, disruptive crane out of the overlap zone, but rather also for other crane work assignments. Crane movements of a plurality of cranes such as tandem hoists that are mutually coordinated can hereby in particular be controlled and performed in a simple manner. A plurality of cranes can in particular be moved in a mutually coordinated manner in that movement data and/or position data and/or state data and/or control commands for moving the first crane are determined by its anti-collision device at at least a first crane during the movement to be mutually coordinated and are transmitted to a second crane, wherein the movement data and/or position data and/or state data and/or control commands of the first crane are displayed on a display apparatus at the second crane and/or are used by the control unit of said second crane for controlling at least one movement device of the first and/or second cranes for performing the mutually coordinated movement.

In comparison with the previous coordination that substantially takes place in that the two crane operators communicate with one another by means of radio telephone devices and are optionally complemented by an external supervision in a tandem hoist, the object is considerably facilitated if every crane operator receives exactly the position information and/or movement information of the other crane currently announced or displayed, to the extent they are determined by the respective anti-collision devices. It is likewise helpful if, alternatively or additionally, the control commands are also mutually displayed so that crane movements of the respective other crane initiated by the respective control commands can be anticipated.

Alternatively or additionally to such a mutual display of the position data and/or movement data and/or state data and/or control commands, the data or information and/or control commands transmitted by the mutually networked anti-collision devices can also be used to semiautomatically or fully automatically influence the crane movements to be mutually coordinated. One of the cranes or its control unit can in particular process the transmitted position data and/or movement data and/or state data and/or the transmitted control commands such that at least one movement device is controlled such that the crane receiving said data or control commands performs a crane movement that maps the crane movement of the other crane in a desired manner. A synchronous crane movement can in particular be performed using the received data and/or control commands. In this respect, the control commands generated at a crane can be used both for controlling the drives of their "own" crane and by remote control transmission for controlling the drives of the at least one further crane so that a crane operator at the first crane simultaneously also controls the second crane or two cranes are controlled simultaneously by a control unit of one crane.

Depending on the desired coordination of the crane movement, this does not, however, actually have to be a synchronous crane movement or a crane movement identical in direction. It can, for example, be a contrary crane movement if an object to be raised together is to be rotated or is to be moved out of a horizontal pick-up position into a slightly slanted installation position.

The control unit of a respective crane can in particular have a slave operating mode in which the control unit of the crane controls at least one movement device using the transmitted movement data and/or control commands such that the crane follows the crane movements of the crane transmitting the data in the desired manner, in particular at least approximately synchronously or contrary, for example.

In a further development of the invention, the crane movements can be mutually coordinated using the alternatingly transmitted condition data and/or status data and/or control commands that are provided by the mutually communicating anti-collision devices such that the cranes carry out a tandem hoist, for example.

In an advantageous further development of the invention, at least the control unit of a crane can have a teach-in mode in which the control unit learns a movement sequence and/or a trajectory using movement data and/or position data and/or control commands that are transmitted from a different crane. The aforesaid remote control mode can, for example, be used to teach the crane to be remote controlled a trajectory that can then be invoked to perform, together with another crane, said tandem hoist or another mutually coordinated crane hoist. The corresponding data and control commands for such a teach-in can likewise be transmitted over the communication network of the anti-collision devices.

BRIEF DESCRIPTION OF THE DRAWINGS

The invention will be explained in more detail in the following with reference to a preferred embodiment and to associated drawings. There are shown in the drawings.

DETAILED DESCRIPTION

Figure 1:
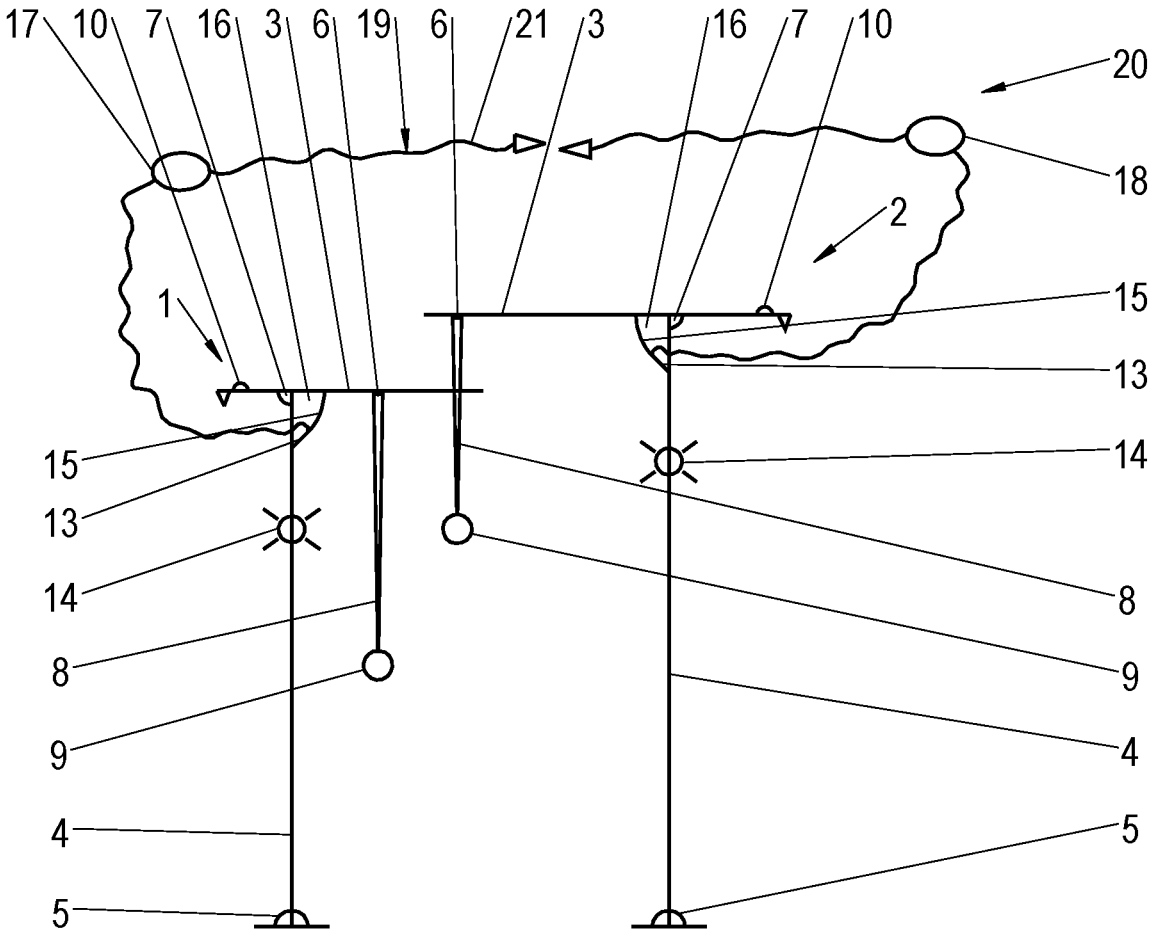
FIG. 1: a schematic representation of two cranes that have partly overlapping working zones and are each equipped with anti-collision devices that can communicate with one another.

As the Figures show, the cranes 1 and 2 can each be configured as revolving tower cranes whose booms 3 are respectively seated on a tower 4 and can be rotated about an upright axis by means of a slewing gear 5, with the cranes being able to be configured as top-slewers or as bottom-slewers. A trolley 6 can be traveled along said boom 3 by a trolley undercarriage 7 to be able to change the outreach of the hoist rope 8 running off from the trolley 6 and of the lifting hook 9 fastened thereto. Said hoist rope 8 can be brought in or let out by a hoisting gear 10 to raise or lower the lifting hook 9.

Figure 2:
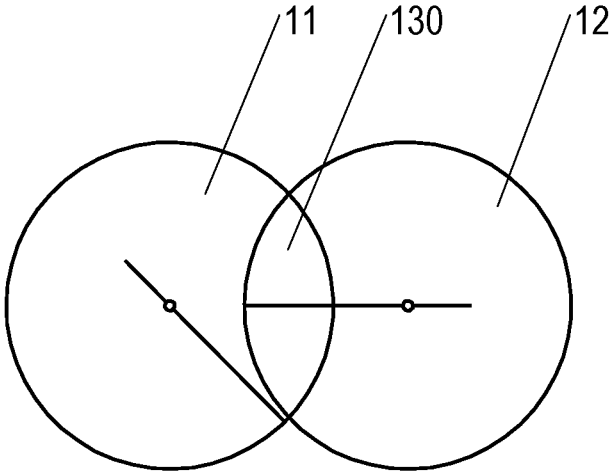
FIG. 2: a plan view of the two cranes of FIG. 1 that illustrates their overlapping zones.

As FIG. 2 shows, the cranes 1 and 2 can have substantially circular working zones 11 and 12 that partially overlap, with the overlap of the working zones 11 and 12 being marked by reference numeral 130. Said working zones 11 and 12 are produced by the rotatability of the booms 3 and by the travel capability of the trolley 6.

As FIG. 1 shows, the booms 3 of the cranes 1 and 2 can be arranged at different heights so that the booms 3 can be moved past over one another or below one another per se. However, depending on the position of the trolley 6, collisions with the hoist rope 8 running down can nevertheless occur. It is, however, understood that the booms 3 of the cranes 1 and 2 can also be arranged at the same height so that the booms 3 themselves could collide with one another.

Each of the cranes 1 and 2 has a crane control having an electronic control unit 13 that can have a microprocessor, for example, to be able to work through control programs stored in a memory. Each crane further comprises a sensor system 14 to be able to determine movements and/or the position of the movable crane elements, in particular the rotational position of the boom 3, the position of the trolley 6 at the respective boom 3, and the height of the lifting hook 9. This can be determined, for example, by sensors that are associated with the slewing gear 5, the trolley undercarriage 7, and the hoisting gear 10. Alternatively or additionally, GPS sensors can also be used that can determine the positions of the crane elements in a global position system. Other determination means such as radar sensors can likewise be provided.

Input means 15 for inputting control commands that control the crane movements can be connected to said control unit 13. Said input means 15 can be provided in a crane operator's cab, for example.

Each of the cranes 1 and 2 further comprises an anti-collision device 17 and 18 that monitors the crane movements of the respective crane, for example by evaluating the signals of said sensor system 14. As FIG. 1 illustrates, the anti-collision devices 17 and 18 of the cranes 1 and 2 can communicate with one another over a communication network 19 of the anti-collision system 20 to which the anti-collision devices 17 and 18 belong so that the cranes 1 and 2 at risk of colliding or the anti-collision devices 17 and 18 each know the position which the other crane is in or which movement the other crane is respectively just carrying out. For this purpose, the anti-collision devices 17 and 18 transmit position data and/or movement data and/or status data of "their" crane to the respective other crane over said communication link 19 of the anti-collision system 20.

The anti-collision devices 17 and 18 can respectively evaluate said data and can for this purpose, for example, carry out a collision determination program that can be stored in a memory and that can be executed by a microprocessor of the electronic anti-collision device. If a collision is imminent, the respective anti-collision device 17 or 18 can intervene in the control of its own crane can, for example, display a warning signal to the crane operator and/or can stop the movement of the crane.

If there is a risk of a collision with a crane that is unoccupied and taken out of operation on a movement to be carried out, a procedure as follows can be performed:

If, for example, the first crane 1 wants to travel into the overlap zone 130 of the two working zones 11 and 12, as FIG. 2 shows, when the boom 3 of the second crane 2 that is unoccupied and taken out of operation there, the anti-collision device 17 of the first crane 1 first outputs a warning signal and intervenes as necessary in the crane control of the first crane 1 to stop the crane movement and to prevent a collision.

To now be able to drive the unoccupied second crane 2 out of the overlap zone 130, the anti-collision device 17 of the first crane 1 stops the first crane 1, with the drives being able to be stopped and the movement devices being able to be braked, in particular the slewing gear 5 of the trolley travel drive 7 and the hoisting gear 10. The control unit 13 can continue to be switched into a remote control mode and/or the control command connection of the control unit 13 of the first crane 1 to its drive devices can be deactivated so that an actuation of the input means 15 cannot effect any travel movements at the first crane.

To be able to set up a remote control connection to the second crane 2, a wake-up signal can furthermore be sent over the communication network 19 of the anti-collision system 20 from the first crane 1 to the second crane 2 to wake up its control unit 13 and to switch into a remote control mode. Said wake-up signal can be generated by the anti-collision device 17 of the first crane or its control unit 13 and can be sent to the second crane 2 over the network 19.

If the first crane 1 has been stopped in said manner and if the second crane 2 has been woken up, a remote connection or a remote control connection 21 can be set up between the cranes over the communication network 19 of the anti-collision system 20 to transmit control commands generated at the first crane 1 to the second crane 2. Said control commands can be generated by actuating the input means 15 of the control unit 13 of the first crane so that the crane operator of the first crane 1 can control the second crane in a customary manner per se and can move it out of the collision zone, that is out of the overlap zone 130.

If the second crane 2 has been moved out of the overlap zone 130, the crane 2 is braked via the remote control connection 21 and is stopped again.

The first crane 1 or its anti-collision device 17 and/or its control unit 13 then logs off from the second crane 2 again and logs back into its own control. The previously named remote control connection 21 is in particular deactivated again and the control unit 13 of the first crane 1 is set back into the normal operating mode from the previously named remote control mode to in turn control its own drive devices.

Finally, the first crane 1 can carry out the intended crane movement into or beyond the overlap zone 130.

Figure 3:
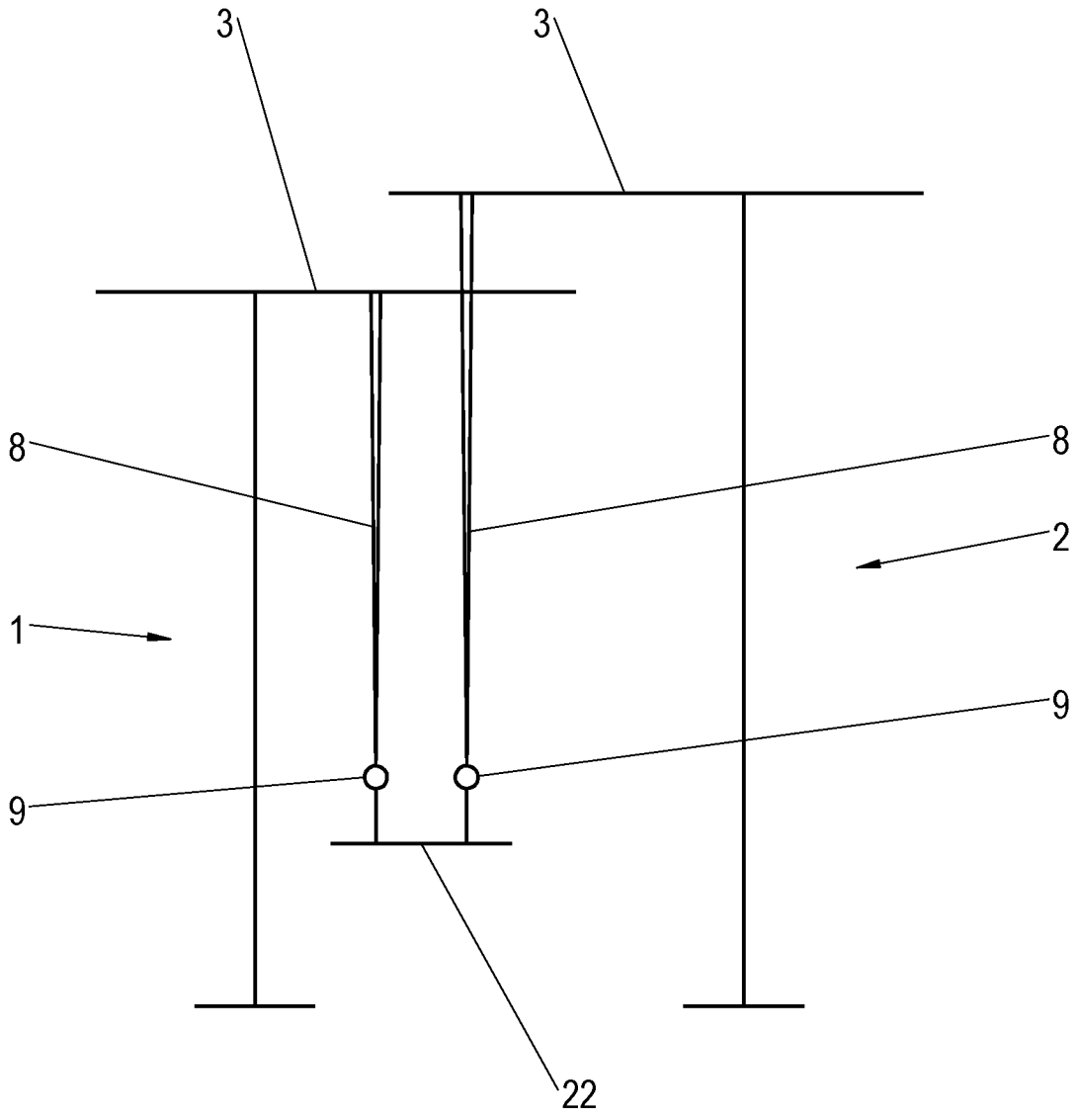
FIG. 3: a schematic side view of the two cranes of FIG. 1 on performance of a tandem hoist.

FIG. 3 illustrates a further deployment option that said remote control mode or the communication over the anti-collision system 20 makes possible. The two cranes 1 and 2 can in particular carry out mutually coordinated crane movements in a simple manner, for example in the form of a tandem hoist in which a common workpiece 22 is fastened to the lifting hooks 9 of both cranes 1 and 2 and is raised together by both cranes 1 and 2. In such a tandem hoist, the workpiece 22 can be raised and/or lowered and/or traveled from a first point to a second point, with the travel path being able to be linear or also curved and with the workpiece 22 being able to maintain its orientation in space or angular position or also being able to be rotated.

Provision can first be made for this purpose in a simple embodiment of the invention that the mutually communicating anti-collision devices 17 and 18 each transmit the position data and/or movement data and/or status data respectively determined at their crane to the other crane, with them being able to displayed at the respective receiving crane, for example on a display that the crane operator can see. Due to the alternating mutual display of said data at the respective other crane, the respective crane operator is always aware of the position or location the respective other crane is in or the direction in which the respective other crane is moving.

Alternatively or additionally, control commands can in this process also be transmitted from one crane to the other crane and may be displayed there, with the control commands that are generated at the first crane 1 by actuating its input means and that move the first crane accordingly being able, for example, to be transmitted to the second crane 2. If the control commands are displayed there, that is at the second crane 2, the crane operator there can correspondingly replicate the corresponding control commands.

Alternatively or additionally, such control commands transmitted from crane to crane can, however, also be used in a remote control mode to move the crane receiving the control commands synchronously with the crane sending the control commands. In the previously named remote control mode, the receiving control unit can implement the commands accordingly to move the receiving crane synchronously with the sending crane.

Furthermore, in the already previously described manner, a crane can also be taught in a corresponding manner to learn a desired trajectory in a teach-in mode that can then be activated or invoked for a mutually coordinated movement of the two cranes.

I claim:

1. A method of operating cranes whose movements are monitored for imminent collisions by anti-collision devices of the cranes, wherein on an imminent collision between a first crane in operation and a second crane out of operation, the first crane is stopped;

a remote control connection is set up from the first crane to the second crane;

the second crane is moved out of a collision zone that disrupts an intended movement of the first crane by control commands that are generated at the first, stopped crane and that are transmitted to the second crane by the remote control connection; and the second crane is stopped and the first crane is set into motion again and is moved after the second crane is moved out of the collision zone.

2. The method of claim 1, wherein a control unit of the second crane is woken up and set into a remote control mode by a wake-up command that is transmitted over a communication connection between the anti-collision devices from the first crane to the second crane to set up the remote control connection.

3. The method of claim 1, wherein on the stopping of the first crane, a control command connection between a control unit of the first crane and at least one movement device of the first crane is deactivated and/or a control command connection of input means of the control unit of the first crane to a remote control module of the first crane is activated.

4. The method of claim 1, wherein on the stopping of the first crane, at least one movement device of the first crane is braked.

5. The method of claim 1, wherein the control commands are generated in a manual remote control mode by actuating input means of a control unit of the first crane that are provided to control movements of the first crane.

6. The method of claim 1, wherein the control commands are generated automatically or semiautomatically in an automatic remote control mode by a movement control module of the anti-collision device of the first crane.

7. The method of claim 6, wherein the control commands are generated by the movement control module in dependence on position data and/or movement data that characterize the position and/or movement of the first crane and/or in dependence on position data that characterize the position and/or location of the second crane were/are transmitted from the anti-collision device of the second crane to the anti-collision device of the first crane.

8. The method of claim 1, wherein the control commands are transmitted from the first crane to the second crane over a communication connection between the anti-collision devices.

9. The method of claim 1, wherein the first crane is stopped before the setting up of the remote control connection and the remote control connection is ended before the putting back into motion of the first crane.

10. The method of claim 1, wherein on the stopping of the first crane, a slewing gear of the first crane is braked.

11. A method of operating a plurality of cranes whose movements are monitored for imminent collisions by anti-collision devices of the plurality of cranes, wherein the plurality of cranes are moved in a mutually coordinated manner, with movement data and/or position data and/or status data and/or control commands determined at at least a first crane during movement of its anti-collision device to be mutually coordinated and transmitted to a second crane, with the movement data and/or position data and/or status data and/or control commands determined at the first crane being displayed on a display device at the second crane and/or being used by a control unit of the second crane to control at least one movement device of the first and/or second crane for carrying out the mutually coordinated movement.

12. The method of claim 11, wherein the control unit of the second crane has a slave operating mode in which the control unit of the second crane controls at least one movement device of the second crane using the transmitted movement data and/or position data and/or status data of the first crane and/or using control commands transmitted by the first crane such that the second crane follows crane movements of the first crane at least approximately synchronously and/or converts them in a predetermined manner into crane movements of the second crane.

13. The method of claim 11, wherein the crane movements of the first and second cranes are mutually coordinated with reference to the alternatingly transmitted movement data and/or position data and/or status data and/or control commands that are provided and/or transmitted by the anti-collision devices such that the first and second cranes carry out a tandem hoist.

14. A first crane comprising at least one movement device for moving a crane element, a control unit for controlling the at least one movement device, and an anti-collision device for monitoring crane movements of the crane element for possible collisions with a second crane, wherein the anti-collision device has a remote control operating mode in which, on an imminent collision between the first crane in operation and the second crane out of operation, the first crane is stopped;

a remote control connection is set up from the first crane to the second crane;

the second crane is moved out of a collision zone that disrupts an intended movement of the first crane by control commands that are generated at the first, stopped crane and that are transmitted to the second crane by the remote control connection; and the second crane is stopped and the first crane is set into motion again and is moved after the second crane is moved out of the collision zone.

15. The first crane of claim 14, wherein the anti-collision device has a movement coordination operating mode in which the movement of the crane element is coordinated with the movement of a further, second crane element, with movement data and/or position data and/or status data and/or control commands being determined during the mutually coordinated movement of the anti-collision device of the crane element and being transmitted to the further, second crane element to be displayed on a display apparatus there and/or being used by a control unit of the second crane to control at least one movement device of the first and/or second crane to carry out the mutually coordinated movement.

16. The first crane of claim 15, wherein the control unit of the first crane has a slave operating mode in which the control unit of the first crane controls the first crane using movement data and/or position data and/or status data transmitted by the second crane, and/or using control commands transmitted by the second crane and/or controls the at least one movement device using control commands transmitted by the second crane such that the first crane synchronously maps crane movements of the second crane.

17. The first crane of claim 16, wherein the crane movements of the second crane are synchronously followable by the first crane.

18. The first crane of claim 14, wherein the at least one movement device comprises a boom adjustment mechanism for adjusting a crane boom.

19. The first crane of claim 14, wherein the at least one movement device comprises a boom adjustment mechanism for adjusting a slewing gear for rotating a crane boom about an upright axis.

* * * * *